US009802106B2

(12) United States Patent
Docter et al.

(10) Patent No.: US 9,802,106 B2
(45) Date of Patent: Oct. 31, 2017

(54) BOARD SPORTS STRUCTURAL ELEMENT

(71) Applicants: Lloyd W. Docter, Tacoma, WA (US); Timothy Mackey, Tacoma, WA (US)

(72) Inventors: Lloyd W. Docter, Tacoma, WA (US); Timothy Mackey, Tacoma, WA (US)

(73) Assignee: DASHBOARDS SKIMBOARD CO., LLC, Fife, WA (US)

( * ) Notice: Subject to any disclaimer, the term of this patent is extended or adjusted under 35 U.S.C. 154(b) by 0 days.

(21) Appl. No.: 15/068,623

(22) Filed: Mar. 13, 2016

(65) Prior Publication Data

US 2017/0259160 A1 Sep. 14, 2017

(51) Int. Cl.

| | |
|---|---|
| ***A63C 5/052*** | (2006.01) |
| ***A63C 17/01*** | (2006.01) |
| ***A63C 5/00*** | (2006.01) |
| ***A63C 5/12*** | (2006.01) |
| ***A63C 5/03*** | (2006.01) |
| ***B63B 35/79*** | (2006.01) |

(52) U.S. Cl.

CPC ..... *A63C 5/006* (2013.01); *A63C 5/03* (2013.01); *A63C 5/052* (2013.01); *A63C 5/12* (2013.01); *A63C 5/126* (2013.01); *A63C 17/01* (2013.01); *A63C 17/017* (2013.01); *B63B 35/7906* (2013.01)

(58) Field of Classification Search

CPC .. A63C 5/006; A63C 5/03; A63C 5/12; A63C 5/126; A63C 17/01; A63C 17/017; A63C 2201/02; A63C 5/052; B63B 35/7906

USPC ..... 280/87.021, 87.041, 87.042, 608, 609, 280/610, 14.21

See application file for complete search history.

(56) References Cited

U.S. PATENT DOCUMENTS

| | | | | |
|---|---|---|---|---|
| 3,501,161 A * | 3/1970 | Holmberg | A63C 5/062 280/610 |
| 8,002,296 B2 * | 8/2011 | Meader | A63C 17/01 280/87.041 |
| 2003/0151229 A1 * | 8/2003 | Muff, Jr. | A63C 5/03 280/608 |

* cited by examiner

*Primary Examiner* — John D Walters

(57) ABSTRACT

A sports board comprises, at a minimum, a top layer, a bottom layer, and a core in between them. A structural element with puzzle piece shape fits into a correspondingly shaped seat formed by the core, in between the top and bottom layers. The shape of the structural element prevents the structural element from being dislodged by shock forces frequently associated with use of the board. Machined or molded features are provided that penetrate or partially penetrate the structural element. These features, which are filled or included with resin, adhesive or another chemical bonding agent, resist horizontal shearing between the structural element, the core, and the top and bottom layers. A leading portion of the structural element protrudes out from in between the top and bottom layers, forming a bumper that acts as the first point of contact between the board and the ground or an obstacle.

12 Claims, 11 Drawing Sheets

BOARD SPORTS STRUCTURAL ELEMENT

FIELD OF THE INVENTION

The field of the invention is skateboards, longboards, water sports board, snowsports board, skis, and other board-sports platforms and products hereafter referred to as board sports board(s) that is made using multiple materials or multiple layers of materials also referred to as composites. The invention is referred to hereafter as the structural element.

BACKGROUND

A composite board sports board typically comprises a core material that is sandwiched between adjacent composite reinforcement panels. The board supports the rider and resists bending moments by putting the composite reinforcement panels in tension or compression. It is important that the interface between core and composite reinforcement panels resist shear forces that come from vertical loads from the rider or horizontal impact loads typically caused by the board striking an object.

U.S. Pat. No. 4,182,520 to Stevenson describes a bumper for a two-piece injection molded skateboard. The skateboard structure has a central platform formed of a top piece and a bottom piece. The two pieces have a cellular inside configuration so that when the two pieces are fitted together they define an internal reinforcing honeycomb-like core. These pieces, moreover, clamp together to retain a removable and replaceable bumper formed of appropriate resilient material, such as rubber or plastic.

U.S. Pat. No. 6,036,218 to Muff describes a snow board with a tip protector embedded into the upper surface of each of the tip portions of the board. The tip protector is a generally flat curved strip of ductile sheet material bonded to a portion of the upper surface of the rounded tip portion adjacent to and aligned with the edge of the device. Muff does not teach channels, pockets, or surface irregularities to bond the top and bottom panels of the board.

U.S. Pat. No. 9,067,125 to Colon describes a skateboard with a curved plate mounted on and flush with a recessed end to facilitate the execution of an "ollie" maneuver. The plate is mounted to the surface and does not protrude past the perimeter of the adjoining board materials. The plate is also designed for removal and replacement and does not provide structural features, such as columns, pockets, or surface irregularities, for bonding adjacent components of adjoining composite surfaces together.

US20060125199 to Kodames describes a skateboard with gripping grooves and metal plates under the skateboard deck's front and rear end to protect the actual deck from serious damage. Like other prior art, Kodames applies its element to a single surface and does not make use of surface irregularities, partial penetrations or full penetrations to bond adjacent structural panels together.

BRIEF DESCRIPTION OF DRAWINGS

The benefits, features, and advantages of the present invention will become better understood with regard to the following description, and accompanying drawings where.

DETAILED DESCRIPTION

Figure 1:
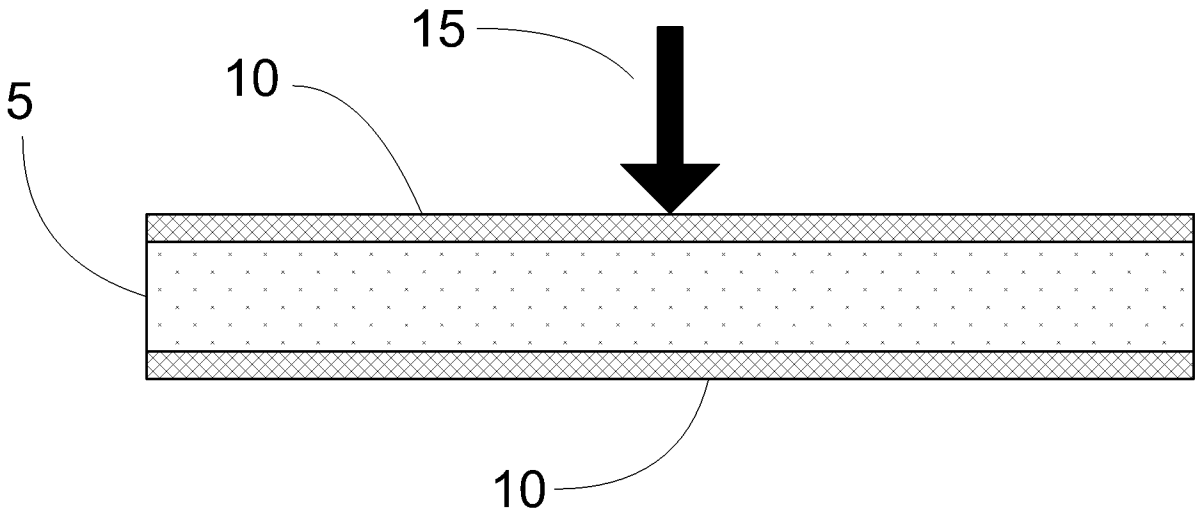
FIGURE 1 PRIOR ART
FIG. 1 is a free body diagram of a composite board and forces exerted on it.

The following description is presented to enable one of ordinary skill in the art to make and use the present invention as provided within the context of a particular application and its requirements. Various modifications to the preferred embodiment will, however, be apparent to one skilled in the art, and the general principles defined herein may be applied to other embodiments. Therefore, the present invention is not intended to be limited to the particular embodiments shown and described herein, be is to be accorded the widest scope consistent with the principle and novel features herein disclosed.

FIGS. 2A-6 illustrate various aspects of a board 35 and improvements thereto. The board 35 is, in various implementations, a skateboard, long board, water sports board, snowsports, skis or board-sports platform, all of which are generally known for providing a standing platform on which the rider will stand or occupy to ride. The board 35 supports the rider's weight 15 and transmits steering inputs to other mechanisms connected to the board or to the riding surface itself.

In one embodiment, the board 35 comprises a core 5 sandwiched between top and bottom layers referred to as composite reinforcement panels 10. The core 5 is typically made of closed cell foam, laminated wood veneer, or vertically laminated wood veneer or pieces. The laminated wood veneer may be made of maple or any other species and having any wood grain alignment. The core may alternatively be made of metal, polymers, resins, fibers, or fiber reinforced plastics. The composite reinforcement panels 10 are comprised, in one embodiment, of fiberglass cloth, and in others of wood veneer, other types of cloth, and other materials. They may alternatively be comprised of any of the materials that can make up the core 5 or any of the materials that could make up the structural element 25, described below. In various embodiments, the core 5 either has a different material composition than the composite reinforcement panels 10 or a different grain orientation, species of wood, and/or thickness than the composite reinforcement panels 10.

The board 35 also comprises a structural element 25 substantially contained between the top and bottom layers 10 and interfaced with the core 5. In one embodiment, the structural element 25 is manufactured as an integral part of the board's core 5. In another embodiment, the structural element 25 comprises a prefabricated piece that is distinct from the core 5 and installed into the core 5 during the manufacturing and lamination process. Additional layers of material may be added to the external face of the top and bottom layers for decorative, structural or functional purposes and in this case shall be considered to be an integral part of the top or bottom layer 10 as called out in the drawings.

Figure 5:
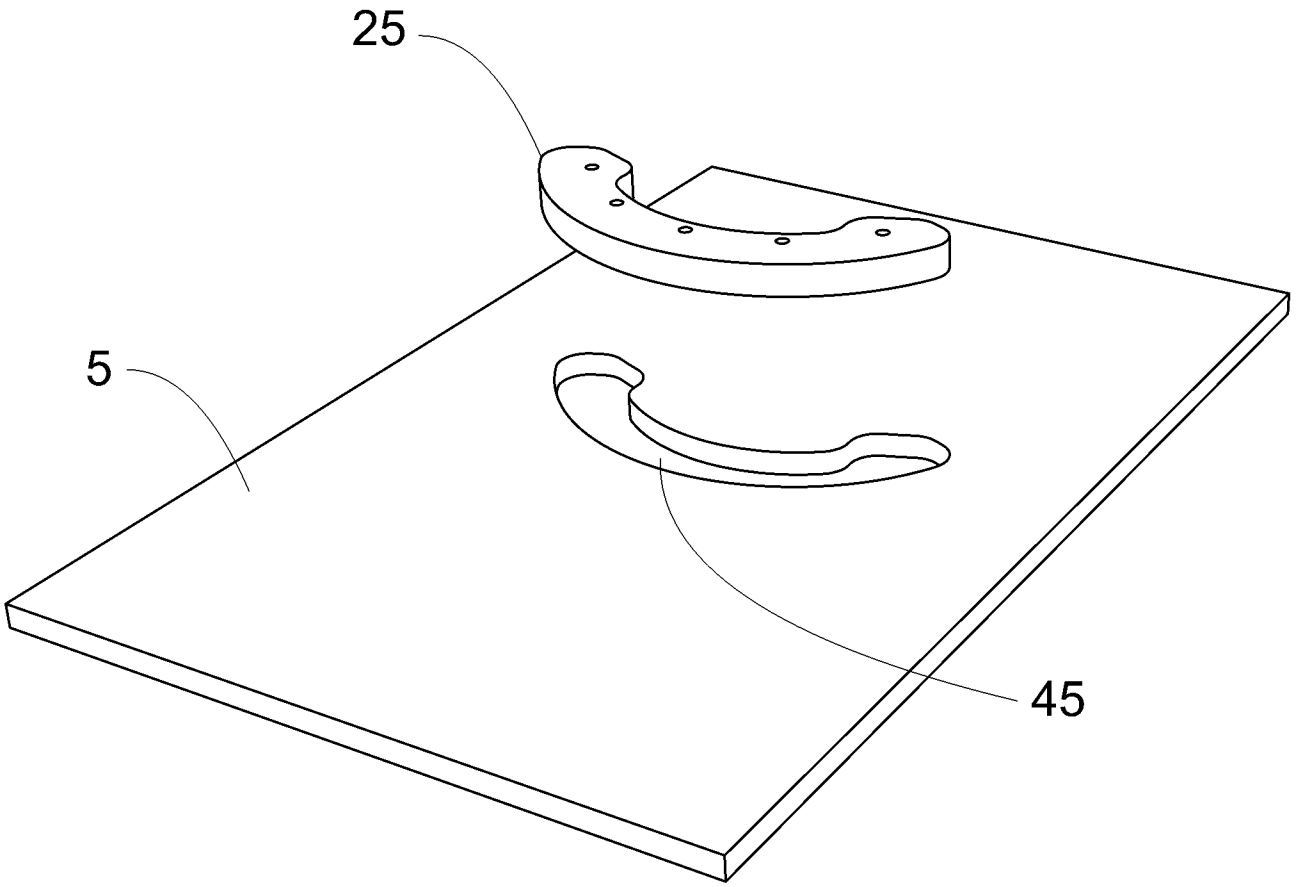
FIG. 5 is a perspective view showing one embodiment of the structural element and a similar shaped core void.
Figure 6:
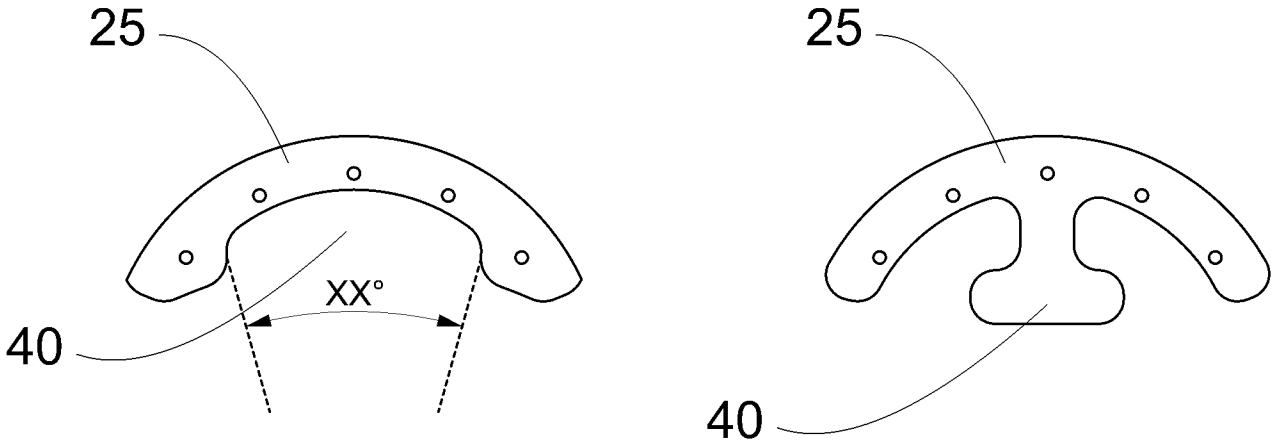
FIG. 6 is a plan view of two different embodiments of the structural element, both taking the form of puzzle piece shapes.

In one embodiment, a portion of the structural element 25 is arranged along a front edge of a board 35. The structural element 25 also has a shape that fits into or is molded into a cavity or void or seat 45 of the core 5 that is similar in shape, as illustrated in FIG. 5. In various embodiments, the structural element 25 has any of a variety of "puzzle piece" shapes 40 (FIG. 6) designed to create a mechanical lock between the structural element 25 and the core 5 relative to the horizontal plane of the board 35. This shape 40 fits within and abuts the edges of a correspondingly shaped cavity 45 of the core 5.

The description of the shape 40 as a "puzzle piece" refers to the fact that the corresponding shapes 40 of the structural element 25 and the seat 45 of the core 5 interlock the structural element 25 and the core 5 together. This resists insertion or removal of the structural element 25 into or from the board 35 along the board's longitudinal axis. In other words, the puzzle piece shape 40 of the structural element 25, and the corresponding configuration of the seat 45 of the core 5, prevents the structural element 25 from being pushed into, or pulled out of the seat 45 of the core 5 after the core 5 and top and bottom layers 10 are assembled together.

Accordingly, the "puzzle piece" configuration of the structural element 25 and the core 5 requires that the structural element 25 be incorporated into the board during manufacture and before the top and bottom layers 10 are secured about the core 5. This means that the structural element 25, when in the form of a distinct pre-assembled piece, requires vertical translation, relative to the roughly horizontal aspect of the board 35, to assemble it with the top and bottom layers 10 so that the structural element 25 is seated securely and snugly within the void 45 of the core 5. Alternatively, the structural element 25 is formed by molding or casting the parts in the core 5.

In yet another embodiment, the structural element 25 and core 5 have a keyhole and matching key shape that provide mechanical resistance to any horizontal disengagement force. The combined puzzle piece shape 40 reinforces the connection between the structural element 25 and the board's core 5 and provides mechanical resistance to any disengagement force that is applied parallel to the horizontal plane of the board.

The structural element 25 is largely sandwiched (like the core 5 itself) between upper and lower composite reinforcement panels 10, as illustrated in FIGS. 2A through 4B. However, the structural element 25 extends (or protrudes) past the most distal edges 60 of the composite reinforcement panels 10 to a sufficient extent that it provides the first point of impact, acting as a bumper should that portion of the sports board 35, while being ridden, encounter the ground or an obstacle. As an example, when the structural element 25 is used on the ends of a board, the portion of the structural element 25 that protrudes past the distal ends of the adjoining composite panels 10, hereafter referred to as the protrusion 50, is designed to be the first point of contact in any impact so as to protect the adjoining composite reinforcement panels 10 and core 5 from damage or delamination. Thus, the structural element 25 is arranged so that it absorbs and then transmits impact loads into the adjoining core and proximate composite reinforcement panels. The protrusions 50 are also preferably rounded over, allowing the tip to better absorb shocks without damaging the components of the board 35 to which the structural element 25 is bonded. Also, the leading edge of the protrusion 50 may have a straight and/or curved profile that substantially follows and is roughly equidistant from a corresponding edge of the top or bottom composite reinforcement panels 10.

In one of the embodiments, the structural element 25 comprises a material, such as a polymer or other elastomeric compound, that effectively absorbs and transmits impact or other loads into the reinforcement panels 10 and the board's core 5 without deforming to such a degree that the reinforcement panels 10 are significantly damaged. In one embodiment, the structural element 25 is an elastomeric material or polymeric material with a hardness between Shore 20a and Shore 100d. In a more particular embodiment, the structural element 25 is an elastomeric material or polymeric material, such as polyurethane, with a hardness between Shore 40a and Shore 65d, or other poly ether or poly ester formulations with a durometer of between Shore 50a and 90d. The hardness is preferably softer than Acrylonitrile butadiene styrene (ABS) plastic, a material found in some boards. Also in one embodiment, the polymeric material or similar elastomeric compound is prefabricated and different from the core material 5. Alternatively, the structural element 25 is made of ABS or a similar plastic, machined, injection molded, or cut to the final shape. Alternatively, the structural element 25 is made of aluminum, steel, rubber, or wood that is machined, formed, vulcanized or cut to the final shape. Other materials are also possible.

As shown in the contrasting embodiments of FIGS. 2B, 2C, and 3A & 3B, the structural element 25 is also formed with machined or molded features 30, 31, or 33 that resist horizontal shearing between the structural element 25, the core 5, and the top and bottom layers 10. The features 30, 31 or 33 comprise vertically oriented pockets, slices, siping (thin slits as would be done to a tire to improve traction), channels, or a surface pattern characterized by multiple peaks and valleys along a vertical dimension, which extend from the top and/or bottom reinforcement panels 10 into the structural element 25 to resist shearing forces.

Figure 2A:
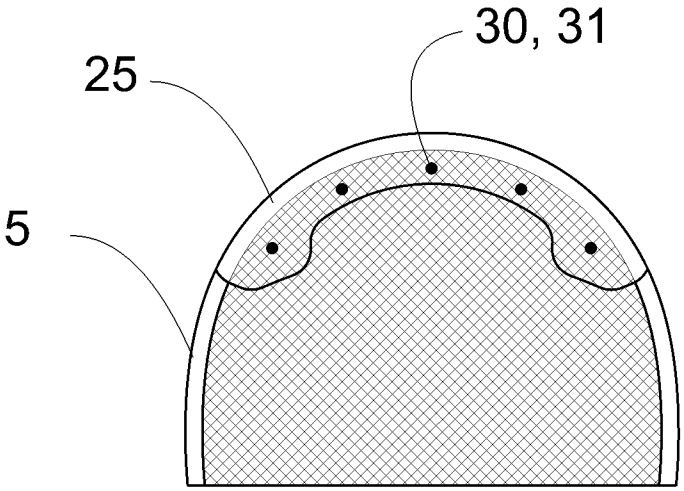
FIG. 2A is a top view of one embodiment of a structural element incorporated into the board and protruding out an end of the board.
Figure 2B:
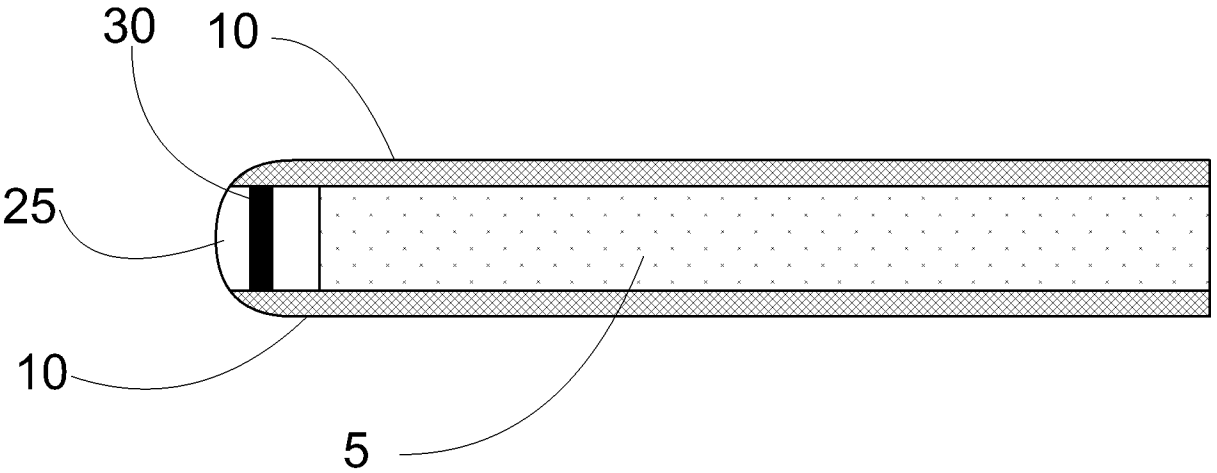
FIG. 2B is a cross sectional view of the board, showing a core and a structural element sandwiched between top and bottom composite panels, and a column filled with resin or other material extending through and joining together the top composite panel, structural element, and bottom composite panel.
Figure 2C:
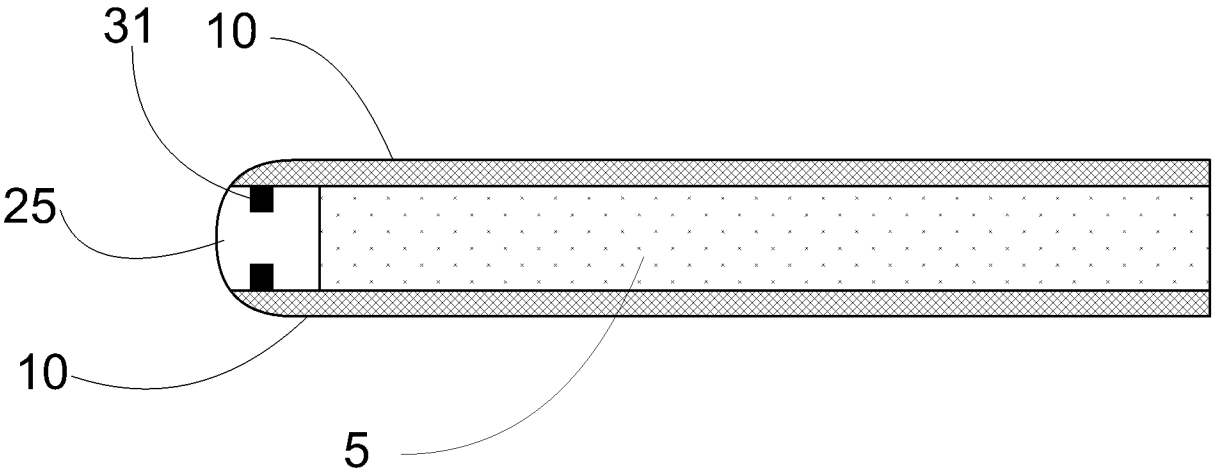
FIG. 2C is a cross section of the board showing joining features that only partially penetration the structural element.
Figure 3A:
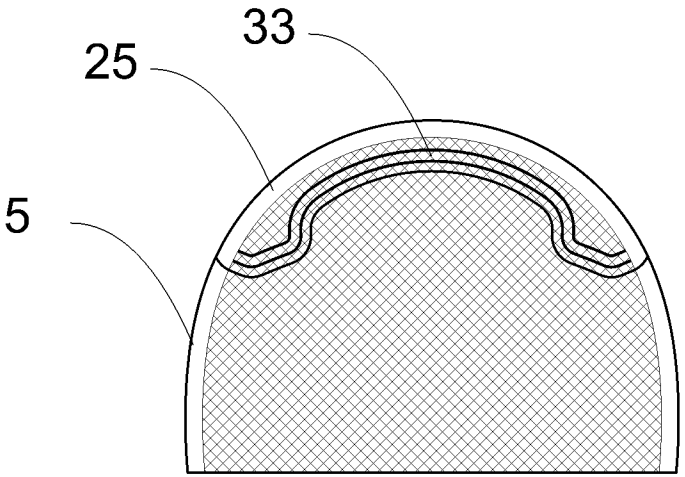
FIG. 3A is a top view of another embodiment of a board having a structural element mechanically locked to the top and bottom composite panels.
Figure 3B:
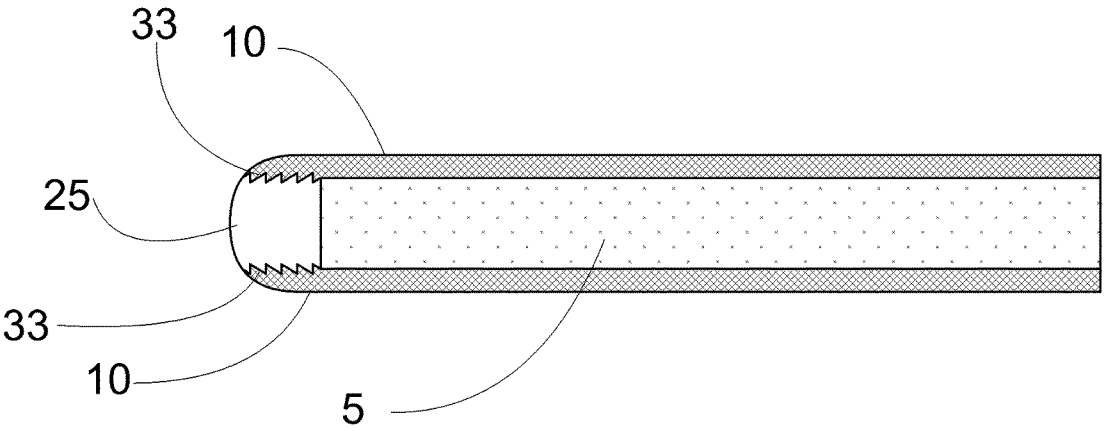
FIG. 3B is a cross sectional view of the board of FIG. 3A, revealing the surface irregularities.
Figure 3C:
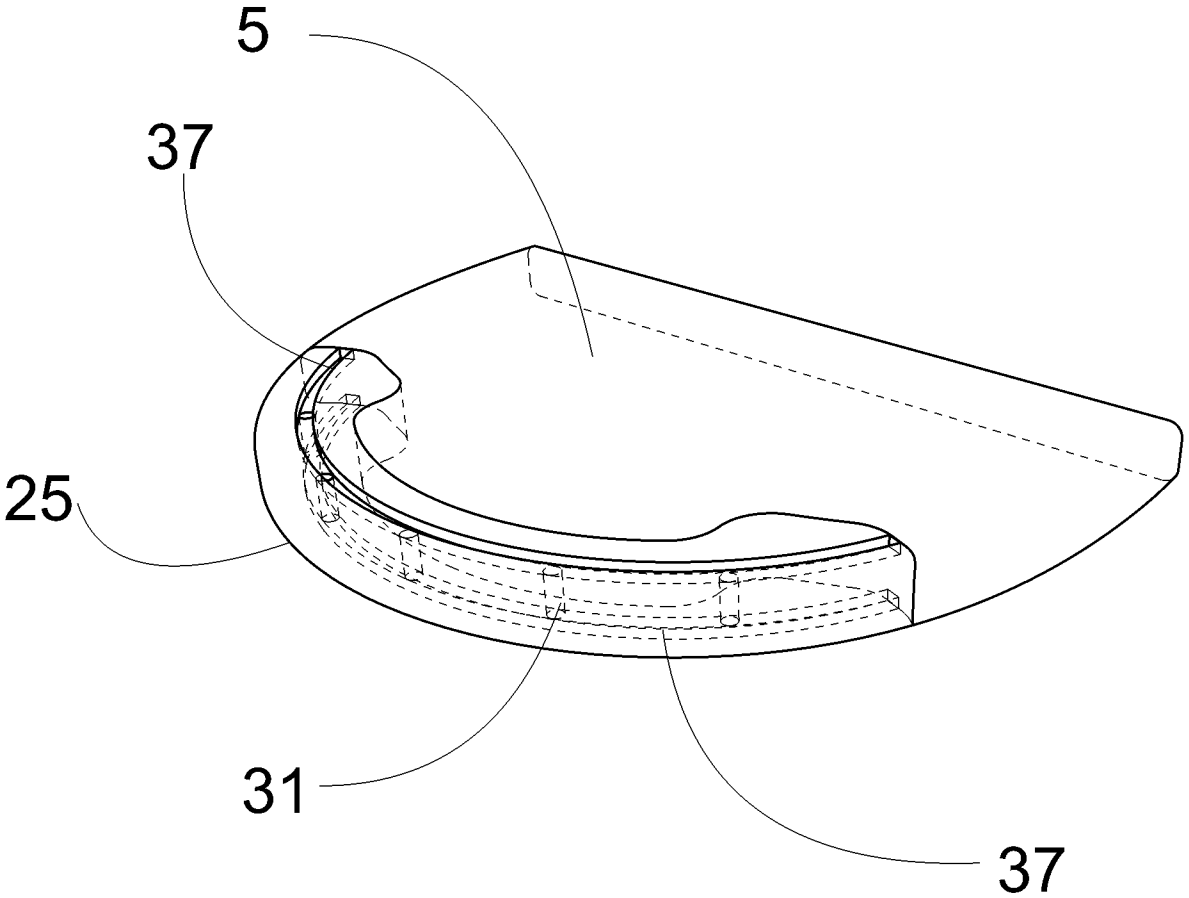
FIG. 3C is a perspective view of the core and structural element featuring penetrations connected by two horizontally oriented channels.

In FIG. 2B, the features 30 comprise channels that penetrate all the way through the structural element 25, extending from the top composite reinforcement panel 10 to the bottom composite reinforcement panel 10. In FIG. 2C, the features 31 comprise pockets that extend from the composite reinforcement panels 10 part way into the material of the structural element 25. In FIGS. 3A and 3B, the features 33 are in the form of a surface pattern characterized by multiple peaks and valleys along a vertical dimension, such as a saw tooth pattern. The features may also take other forms and shapes.

Figure 4A:
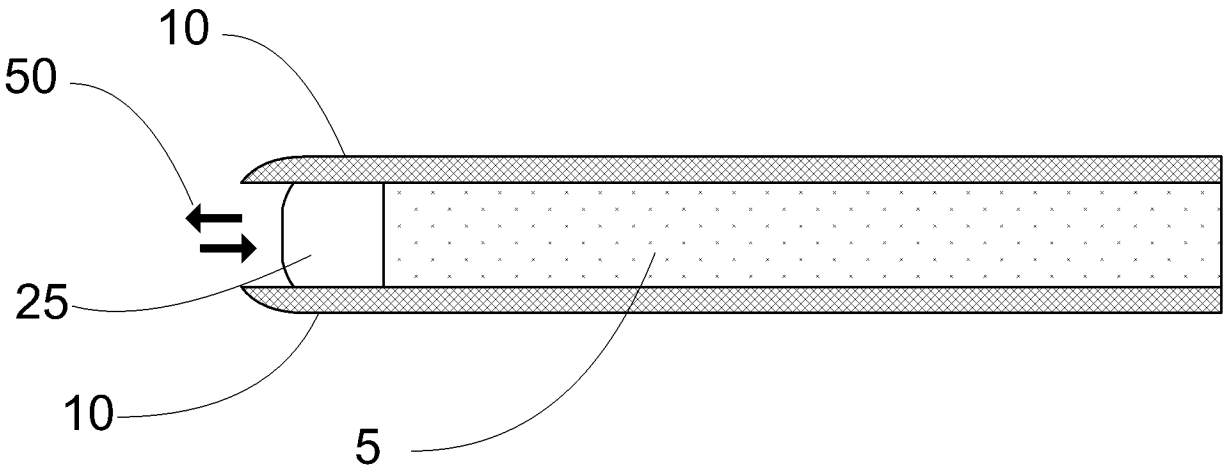
FIG. 4A is a cross section of the board illustrating sheer forces operating against the structural element of a board that lacks any of the mechanically locking features of FIG. 2B, 2C, or 3B.
Figure 4B:
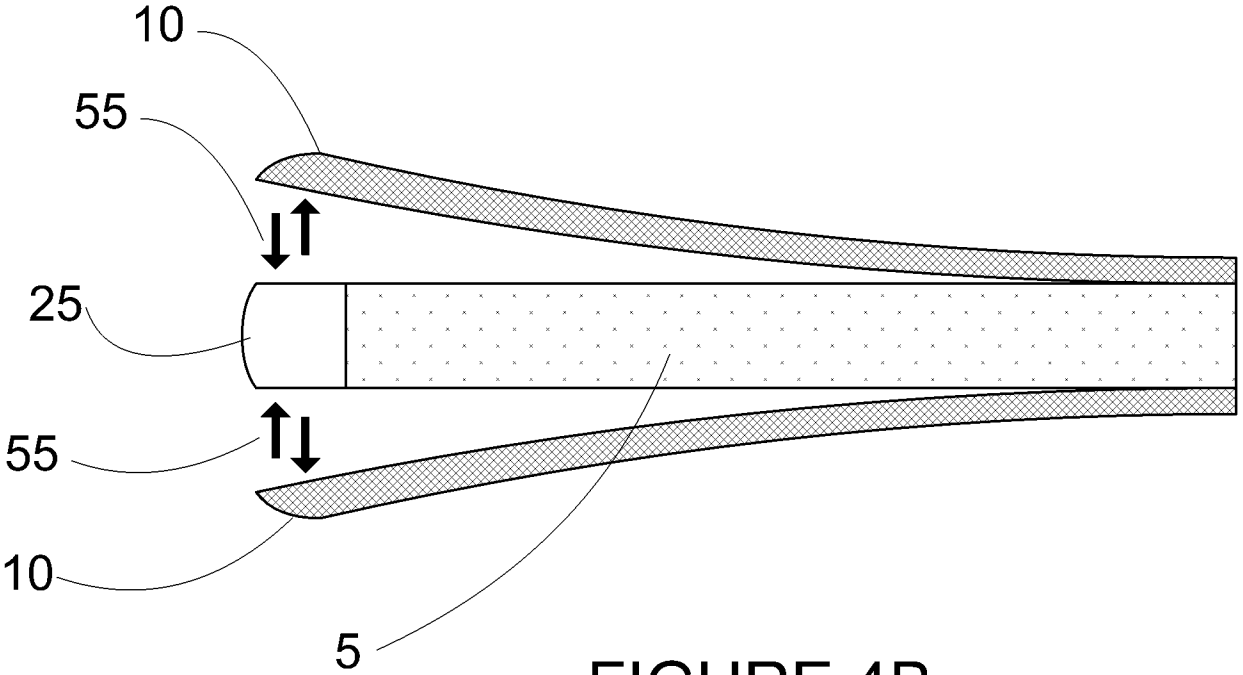
FIG. 4B is a cross section of the board illustrating delamination of the composite panels from the structural element of a board the lacks any of the mechanically locking features of FIG. 2B, 2C or 3B.

The features 30 or 31 include a filling of resin (such as epoxy) and/or fibers and/or any other suitable chemical bonding agent or joining material, forming a chemical/ adhesive rivet that joins and/or bonds the layers of the reinforcement panels 10 together and the reinforcement panels 10 to the structural element 25 itself, resisting forces 55 that would cause the panels 10 to delaminate (FIG. 4B). In FIGS. 3A and 3B, the features 33 include a layer of resin or other suitable joining material that fills the saw tooth voids, and bonds the composite reinforcement panels 25 to the structural element 25 and the core 5. In one embodiment, the resin, adhesive or other chemicals forming the full or partial penetrations are connected with horizontally oriented channel(s) filled with the same resin adhesive or other chemical, creating a singular homogenous bonding feature between the top and bottom reinforcement panels 10 FIG. 3C. The features 30, 31, and 33 also increase mechanical load transmission parallel to the horizontal centerline of the board and provide mechanical resistance to horizontal shearing 50 (FIG. 4A) of the composite reinforcement panels 10 from the structural element 25 and the core 5.

The features 30 of FIG. 2B provide an additional advantage. By going all the way through the structural element 25, the features 30 form columns that bridge the top and bottom layers, providing a new and direct structural connection between the composite reinforcement panels 10, and further reducing the potential for delamination of the composite reinforcement panels 10, the structural element 25 and the core 5.

It will be understood that the invention includes embodiments that provide other forms for the structural element 25 and/or position the structural element 25 along other portions of the board 35. For example, in one embodiment the structural element 25 is positioned on both ends of the board 35. In another embodiment, the structural element 25 fully encapsulates the outer perimeter of the board 35. In yet another embodiment, the structural element 25 is incorporated as an interior component of the board 35, surrounded by the core 5. Also, the structural element 25 may be one or multiple pieces that are adjacent to the main core material 5.

As seen above, the board 35 provides an improved mechanical joining of the composite reinforcement panels 10 to each other and to the core 5, which improves structural durability and impact durability. The board 35 also provides a structural element 25, described below, that absorbs and transmits loads into the core and proximate structural panels to improve structural and impact durability.

The process of manufacturing the board 35 provides further insight into the structure of the board 35. In a series of steps, the core 5, the structural element 25, and the upper and lower composite reinforcing panels 10 are prepared for lamination. In one embodiment, a pre-laminated panel or solid core blank (e.g., closed cell foam, horizontal laminated wood, vertical laminated wood, bamboo, etc.) is machined to provide a seat or void for the structural element 25 to be inserted into and to provide other pre lamination features or shapes. Next, the structural element 25 is inserted into a pre-machined seat 40 of the core blank. Alternatively, the structural element 25 is poured into a pre machined groove in the core. Features 30, 31, or 33 are drilled, machined or molded into the structural element 25.

Next, a fiberglass cloth that will form one of the reinforcement panels is wet out with a resin such as epoxy and is placed on top of a mold or mold liner. The core blank is wet out and placed on top of the already wet out fiberglass cloth. The other side of the core blank is wet out with resin, and a second piece of fiberglass cloth (for the other reinforcement panel 10) is placed on the other side of the core. The second piece of fiberglass cloth is wet out with resin. At this point, any voids in the features 30, 31, or 33 have been filled with resin or adhesive.

The resulting group of components, comprising at least one core, at least one structural element, and two structural fiberglass cloth reinforcement panels 10 is compressed in a mechanically (hydraulic, air, vacuum or mechanical) to remove the excess resin from the assembly and to form the final shape of a board blank. After the components have cured, the blank is removed from the press and cut and/or machined to produce the finished perimeter shape. Machining is also used to cut the profile of the structural element so it protrudes beyond a cut profile for the reinforcement panels 10.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

The invention claimed is:

1. A sports board for supporting a rider's weight, the sports board comprising:

a substantially horizontal top layer formed from a first material;

a substantially horizontal bottom layer formed from a second material;

a core sandwiched between the top and bottom layers and formed from a third material; and a structural element formed from a fourth material substantially contained between the top and bottom layers and interfaced with the core;

wherein the structural element incorporates machined or molded features that resist horizontal shearing between the structural element, the core, and the top and bottom layers, the features comprising vertically oriented pockets, channels, slicing, siping, or a surface pattern characterized by multiple peaks and valleys along a vertical dimension;

wherein the features are filled with a resin or other chemical bonding agent that joins and bonds the layers to the structural element and the structural element is comprised of a fourth material;

wherein the features of the structural element comprise channels that extend from the top layer to the bottom layer and penetrate fully through the structural element, creating a structural connection between the top and bottom layers.

2. A sports board of claim 1, wherein the resin or other chemical bonding agent forms chemical rivets through the features of the structural element that create a structural connection between the structural element and the top and bottom layers.

3. A sports board of claim 1, wherein the resin or chemical bonding agent forms a channel running horizontally across the face of the structural element in a direction perpendicular to partial or full penetrating columns of resin or other chemical bonding agent that connect multiple penetration columns.

4. A sports board of claim 1, wherein the structural element has a shape that fits within and abuts the edges of a correspondingly shaped cavity of the core, wherein the shape prevents the structural element from being inserted or removed into or from the board along the board's horizontal plane, and wherein the shape requires that the structural element be incorporated into the board during manufacture and before the top and bottom layers are secured about the core.

5. A sports board of claim 4, wherein the structural element comprises a discrete component that is incorporated into the sports board during a lamination process.

6. A sports board of claim 4, wherein the structural element is manufactured as an integral part of the core during fabrication of the core.

7. The sports board of claim 1, wherein the structural element is comprised of a fourth material that is an elastomeric material or polymeric material with a hardness between Shore 20a and Shore 100d.

8. A sports board for supporting a rider's weight, the sports board comprising:

a substantially horizontal top layer formed from a first material;

a substantially horizontal bottom layer formed from a second material;

a core sandwiched between the top and bottom layers and formed from a third material; and a structural element formed from polyurethane with a hardness between 40a and 80d, the structural element being substantially contained between the top and bottom layers and interfaced with the core and projecting more than 20% of the structural element's thickness beyond the adjoining horizontal top layer and horizontal bottom layer so as to provide a bumper;

wherein the structural element has a shape that fits within and abuts the edges of a correspondingly shaped cavity of the core, wherein the shape prevents the structural element from being inserted or removed into or from the board along the board's longitudinal dimension, and wherein the shape requires that the structural element be incorporated into the board during manufacture and before the top and bottom layers are secured about the core.

9. The sports board of claim 8, wherein the structural element comprises a discrete component that is incorporated into the sports board during a lamination process.

10. The sports board of claim 8, wherein the structural element is manufactured as an Integral part of the core during fabrication of the core.

11. The sports board of claim 8, wherein the structural element incorporates machined or molded features that resist horizontal shearing between the structural element, the core, and the top and bottom layers, the features comprising vertically oriented pockets, channels, slicing, siping, or a surface pattern characterized by multiple peaks and valleys along a vertical dimension.

12. The sports board of claim 8, wherein the resin or other chemical bonding agent form a channel running horizontally across the face of the structural element in a direction perpendicular to partial or full penetrating columns of resin or other chemical bonding agent that connect multiple penetration columns.

* * * * *